United States Patent [19]

Evans

[11] 4,148,368

[45] Apr. 10, 1979

[54] ROCK BIT WITH WEAR RESISTANT INSERTS

[75] Inventor: Robert F. Evans, La Habra, Calif.

[73] Assignee: Smith International, Inc., Newport Beach, Calif.

[21] Appl. No.: 805,659

[22] Filed: Jun. 13, 1977

Related U.S. Application Data

[63] Continuation-in-part of Ser. No. 726,826, Sep. 27, 1976, abandoned.

[51] Int. Cl.[2] ..... E21B 9/36

[52] U.S. Cl. ..... 175/329; 175/374; 175/410; 76/108 R

[58] Field of Search ..... 175/329, 330, 374, 410; 125/30 R, 39; 76/101 A, 108 R, 108 A; 173/329, 330, 374, 410

[56] References Cited

U.S. PATENT DOCUMENTS

| | | | |
|---|---|---|---|
| 1,506,119 | 8/1924 | Hansen | 175/330 |
| 1,939,991 | 12/1933 | Krusell | 175/330 X |
| 2,121,202 | 6/1938 | Killgore | 175/374 |
| 2,182,562 | 12/1939 | Koebel | 175/410 |
| 3,153,458 | 10/1964 | Short | 175/329 |
| 3,174,564 | 3/1965 | Morlan | 175/330 |
| 3,605,923 | 9/1971 | Feenstra | 175/329 |
| 3,727,705 | 4/1973 | Newman | 175/374 |
| 3,938,599 | 2/1976 | Horn | 175/329 |
| 4,006,788 | 2/1977 | Garner | 175/330 |
| 4,081,203 | 3/1978 | Fuller | 175/3 |

FOREIGN PATENT DOCUMENTS

| | | | |
|---|---|---|---|
| 679193 | 12/1964 | Italy | 175/330 |
| 694925 | 7/1953 | United Kingdom | 175/330 |
| 777257 | 6/1957 | United Kingdom | 175/329 |

*Primary Examiner*—Ernest R. Purser
*Assistant Examiner*—Richard E. Favreau
*Attorney, Agent, or Firm*—Christie, Parker & Hale

[57] ABSTRACT

A tungsten carbide insert for mounting in a rolling cone cutter comprises a base for mounting in the rolling cone cutter, an end converging to the work surface, and a diamond insert embedded in a portion of the work surface to improve the wear resistance of the insert. Preferably the diamond insert is embedded in the portion of the work surface extending farthest from the rolling cone cutter in which the tungsten carbide insert is mounted. Diamond inserts are provided in carbide inserts on the gage row of a cutter. Diamond inserts can also be used in tungsten carbide inserts on the heel row of a rolling cone cutter for maintaining gage of a hole being bored.

8 Claims, 5 Drawing Figures

Fig. 1
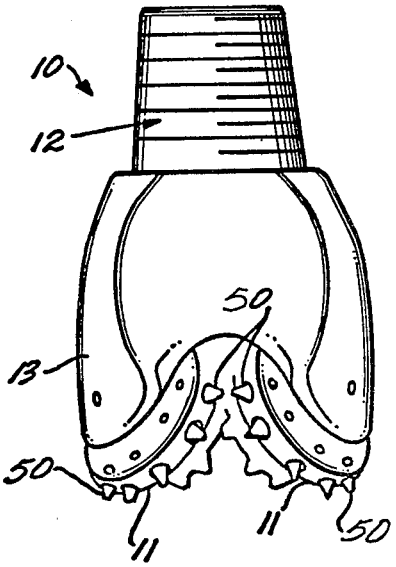
Fig. 2
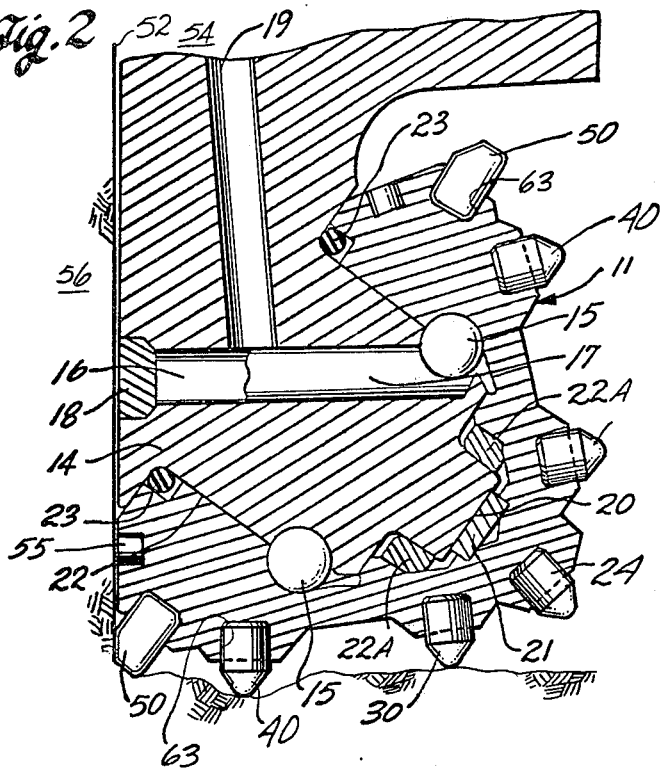
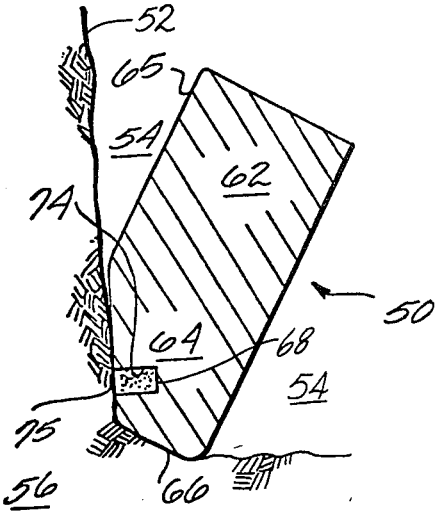
Fig. 3
Fig. 4
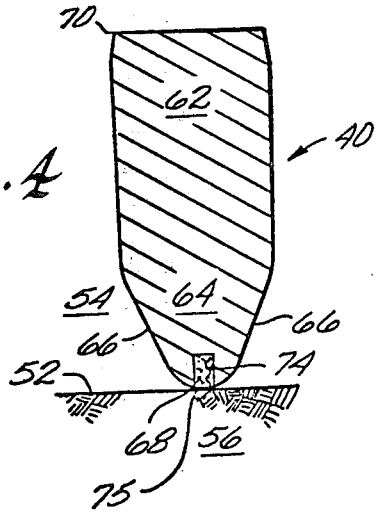
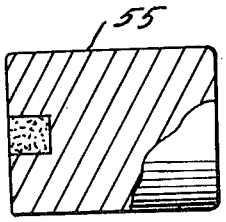
Fig. 5

ROCK BIT WITH WEAR RESISTANT INSERTS

This application is a continuation-in-part of U.S. Patent Application Ser. No. 726,826, filed Sept. 27, 1976, now abandoned.

BACKGROUND

Two principal types of rotary drill bits are employed for rock drilling for oil wells, recovering core samples, and the like. One type of rotary rock drill is a drag bit. Some of these have steel or hard faced teeth, but primarily they are set diamond drills such as described in U.S. Pat. No. 3,174,564. Typically in a set diamond drill the face is coated over much of its area with a hard material in which are embedded or "set" numerous diamonds. Diamonds are brazed into a wear resistant substrate. The diamonds protrude from the surface of the matrix and when the drill is used they rub on the rock, abrading shallow tracks and cutting primarily by a combination of compressive and shearing action.

Another type of bit uses rolling cone cutters mounted on the body of the drill bit so as to rotate as the drill bit is rotated. The use of rolling cone cutters in drilling rock is a well-known and long-established art. A typical rock bit includes three roller cutters, each having a generally conical configuration, and each occupying part of a separate 120° sector above the face of the well bore. Some rock bits for special purposes have two, four or more cutters although three cone bits are probably most commonly used. Each roller is equipped with a number of generally circular rows of inserts or cutting elements. Some cones have hardened steel teeth integral with the cone. Many cones have tungsten carbide inserts or other hard material forming the cutting elements. As the roller rotates the work surfaces of the inserts of each row are applied sequentially in a circular path upon the face of the rock that is being drilled. As the rolling cone cutters roll on the bottom of the hole being drilled, the teeth or carbide inserts apply a high compressive load to the rock and fracture it. The cone axes can be "offset" a small amount from an intersection with the centerline of the rock bit to enhance lateral loading on the rock being drilled. The cutting action in rolling cone cutters is typically by a combination of crushing and chipping.

There are several distinct shapes of tungsten carbide inserts which are standard in the industry for rolling cone cutters, such as a conical, the double cone, the semi-projectile, and the chisel crest. All of these insert shapes, however, are generally characterized in that they comprise a cylindrical base for mounting in a rolling cone cutter and an end converging to a work surface. The work surfaces are blunt-pointed with a somewhat wedge-shaped configuration, meaning that the first engagement with the surface of the rock is but a relatively small surface area, but when indentation into the surface of the rock has progressed, the width or thickness of the cutting element which then comes into contact with the rock is greater.

Combinations of drag bits and rolling cone bits have been proposed. For example, U.S. Pat. No. 3,174,564 to E. A. Morlan for a "Combination Core Bit", has a cylindrical crown encrusted with set diamonds for cutting an annulus around a core. The set diamonds protrude from the matrix tiny distances in the conventional manner. A plurality of rolling cone cutters with carbide inserts are mounted in special recesses around the cylindrical crown for cutting an outer annulus of considerably greater area than the inner annulus cut by the diamonds. Also, U.S. Pat. No. 1,506,119 describes a combination rotary cutting/diamond bit.

In operation, a rolling cone drill bit is attached to the lower end of a drill string and rotated about the longitudinal axis of the drill bit on the bottom of a bore hole. Thus, the rolling cone cutters are caused to rotate, and as weight is applied to the bit by the weight of the drill string, the tungsten carbide inserts of the rollers crush, chip, gouge, and scrape the formation upon which the bit is rotated depending on the presence or absence of skew or "offset" of the cone axis. The particles of rock formation thus dislodged are carried out of the bore hole by drilling fluid which is pumped downwardly through the drill stem and bit head, returning to the surface of the earth via the space between the drill stem and the wall of the bore hole being drilled.

The tungsten carbide inserts along the periphery of a bit and which define the diameter of a hole being drilled are known as gage inserts. As the rolling cone cutters rotate, the gage inserts scrape against rock at the periphery of the hole being drilled as well as contact the bottom of the hole to dislodge rock formation by compression and gouging. Of all the working inserts of a rolling cone cutter, the gage inserts are most susceptible to wear because they undergo both abrasion and compression as they scrape against the periphery of a bore hole to dislodge rock. Any appreciable amount of wear on the gage inserts is undesirable because this could result in an undersized bore hole. If a bore hole is drilled undersized, then when a replacement drill bit is inserted toward the bottom of the bore hole, the replacement bit can pinch against the undersized portion of the hole and experience undue gage surface and bearing wear in reaming the undergage hole, thereby compounding the problem.

Rock bits are made with the gage diameter held within close tolerances. Thus, for example, with a rock bit having a nominal gage diameter of 7 and $\frac{7}{8}$ inch, a standard specification calls for an actual gage diameter not less than 7 and $\frac{7}{8}$ inch, and excess diameter no more than 1/16 of an inch. The gage diameter of the bit is the diameter across the outermost gage inserts on the cones. Thus, for example, the gage of a rock bit is determined by fitting a ring gage over the three cones. A 7 and $\frac{7}{8}$ inch diameter bit would not fit into a ring gage having a diameter smaller than 7 and $\frac{7}{8}$ inch but would fit into a ring gage having a diameter of 7 and 15/16 inch.

The cutter cones on a rock bit are also provided with flat faced tungsten carbide inserts on a portion of the cone which is intermittently adjacent the wall of the hole being drilled and which does not come in contact with the bottom of the hole. Such inserts are mounted substantially on the nominal gage of the rock bit. These inserts are known as the heel row. The abrasion resistant tungsten carbide inserts on the heel row help prevent the rock bit from going under gage. The heel inserts on the rock bit are subject to considerable abrasion and it is desirable to enhance their wear resistance.

Excessive wear on gage and heel inserts can occur even though gage inserts generally are made of tungsten carbide, either by itself or combined with other materials such as cobalt. Although tungsten carbide exhibits good compressive strength, it has relatively poor abrasion resistance when compared to diamond material. Therefore, the gage cutting elements tend to wear faster than other cutting elements, and thereby can be a limiting factor on the life of a drill bit. Excessive wear due to abrasion on the gage cutting elements necessitates premature replacement of the drill bit. Replacement is a time-consuming and expensive process, especially in deep bore holes, since the entire drill string must be removed from the hole in order to change the bit. Also, tungsten carbide inserts in all positions in a rolling cone cutter can exhibit poor wear resistance when drilling through formations interlaced with regions of hot wear containing corrosive salts such as when drilling for sources of geothermal energy.

Therefore, there is a need for tungsten carbide inserts for rolling cone cutters having high compressive strength, good resistance to abrasion, and good wear resistance when used to drill for sources of geothermal energy.

SUMMARY OF THE INVENTION

The present invention concerns tungsten carbide inserts exhibiting the above features for mounting in a rolling cone cutter of a rock drill bit. Such tungsten carbide inserts comprise a base for mounting in a rolling cone cutter, an end converging to a work surface and a diamond insert embedded in a portion of the work surface. In such an embodiment the diamond insert is embedded in the portion of the work surface extending farthest from the rolling cone cutter in which the tungsten carbide insert is mounted for maximum wear resistance. A tungsten carbide insert having a flat end with a diamond inserted therein is also useful. The diamond insert can be a polycrystalline diamond.

Because such tungsten carbide inserts exhibit improved wear resistance, they can advantageously be used as the gage row inserts and heel row inserts for a rolling cone cutter to improve the life of a drill bit. Such diamond inserts on a rock bit contact formation intermittently and are readily cooled.

DRAWINGS

These and other features, aspects and advantages of the present invention will become more apparent upon consideration of the following description, appended claims and accompanying drawings where:

FIG. 1 is a pictorial view of a rock bit having three rolling cone cutters mounted thereon in accordance with principles of this invention;

FIG. 2 is a longitudinal cross-sectional view through one rolling cone cutter of the rock bit of FIG. 1;

FIG. 3 is a cross-sectional view of a gage tungsten carbide insert of the rolling cone cutter of FIG. 2;

FIG. 4 is a cross-sectional view of an interior tungsten carbide insert of the rolling cone cutter of FIG. 2; and FIG. 5 is a cross-sectional view of a heel row insert of the rolling cone cutter.

DESCRIPTION OF THE INVENTION

FIG. 1 illustrates a side view of a rock drill bit 10 having three conical rollers 11. FIG. 2 illustrates in longitudinal cross section the mounting of one of the rollers 11. The conical roller 11 may also be referred to as a cone, a rolling cone cutter, or as a roller cutter. The bit has a heavy duty steel body with a threaded pin joint 12 at one end. The main body of the bit is divided into three legs 13, each terminating in a conventional journal 14 on which the respective cutter cone 11 is mounted.

When the drill bit is assembled ball bearings 15 are added through a ball passage 16 from the exterior of the leg to a ball bearing race on the pin, which is then closed with a ball retainer 17 which retains the balls in place. Typically, the ball retainer is welded in place with a ball plug 18. The ball bearings 15 may carry some radial or thrust load between the journal and the cone, but the primary function of the balls is to retain the roller on the journal. A nose bearing 20 on the journal engages a thrust button 21 in the cone for carrying the principal thrust loads of the bearing structure. The brunt of the radial loads between the cone and journal is carried by the main cylindrical bearing surfaces 22 and bushing 22A. The solid journal bearings and ball bearings are lubricated by grease flowing through a conventional lubricant passage 19 and retained by a sealing element 23.

Referring to FIG. 2, on the nose of the cone 11 there is mounted a single insert 24, which in the particular illustration is a tungsten carbide insert whose forward or cutting end portion is of the conical type. A first circular row of tungsten carbide inserts 30 is mounted near the forward end of the cone 11, while an additional row of interior tungsten carbide inserts 40 is mounted on the cone 11 towards the rearward or base portion thereof. The pattern of tungsten carbide inserts on the other two cones of the three cone bit differ somewhat from the one illustrated in FIG. 2 for optimum drilling action.

Each rolling cone cutter also has an outermost row of carbide inserts 50 generally referred to as the gage row. The inserts in the outermost row are at the largest diameter of the cutter which places them at the periphery of the hole being drilled to maintain its full gage. As the rolling cone cutter rolls during drilling, each gage insert 50 intermittently engages the peripheral wall 52 of the bore hole 54 formed by the drill bit in the rock formation 56. The spacing of the inserts within the rows 30, 40, and 50 on individual rolling cone cutters may be varied in the conventional manner to minimize tracking and maximize cutting efficiency.

The cone also includes a heel row of carbide inserts 55. These inserts are on a portion of the cone which does not contact the bottom of the hole being drilled but is instead adjacent the wall 52 of the hole as the cone rotates. The heel inserts are adjacent the wall of the hole intermittently for 10° or so of the cone rotation. During the balance of each revolution of the cone, the heel inserts as well as other inserts on the face of the cone are remote from the surface of the intact formation being drilled. The heel inserts are particularly subject to wear because of some sliding action adjacent the wall of the hole. It is important to maintain the heel inserts near the nominal gage of the bit so that an undersized hole does not result. All the inserts 24, 30, 40, 50 and 55 are preferably tungsten carbide inserts.

The tungsten carbide inserts are mounted in the cones in mounting recesses 63, all of which with the exception of the heel inserts are approximately the same depth. The diameter of the tungsten carbide inserts is typically larger than the diameter of the recess in which it is mounted. Each tungsten carbide insert is forced into its recess and held in place by a press fit between it and the steel wall of the recess. The compressive force exerted on a tungsten carbide insert from the press fit is proportional to the difference between the diameter of the tungsten carbide insert and the diameter of the recess. Typically, the interference between the tungsten carbide insert elements and the wall of the recess is about 0.002 inch, and this interference holds the cutter elements in with a force of from about 4,000 to about 11,000 pounds.

The actual interference force depends upon many factors, including the surface texture of the tungsten carbide inserts and recess walls, and the shape and size of the recess and the tungsten carbide inserts. For example, the tungsten carbide inserts may be chamfered or fluted, or the tungsten carbide inserts, the recesses, or both, may be tapered so that the interference force either decreases or increases as a tungsten carbide insert approaches the bottom of the recess.

With reference to FIGS. 3 and 4, a tungsten carbide insert for mounting in the outer face of a rolling cone cutter of a rock drill bit comprises a base 62 for mounting in a recess in the rolling cone cutter 11, an end 64 converging to a work surface 66 used for engagement with rock to be drilled, and a diamond insert 68 embedded in a hole 74 in a portion of the work surface 66 for improved wear resistance.

The base 62 is generally cylindrical with a chamfered peripheral edge 70 for ease of insertion into a recess. However, the base can be of irregular shape and may be fluted or tapered.

All of the interior tungsten carbide inserts 24, 30, 40 shown in FIG. 2 are of the conical type. The gage tungsten carbide inserts 50 are of the chisel crest type, where the chisel crest is skewed toward the side 65 of the insert which engages the peripheral wall 52 of a bore hole 54 during drilling. However, the outer end 64 of the inserts can have a variety of shapes such as semi-projectile, double cone, or any other shape known to the art.

Preferably the diamond insert 68 is embedded in a tungsten carbide insert so that the exterior surface 75 of the diamond insert is flush with the surrounding work surface to maximize useful life.

The diamond insert 68 can be embedded in any portion of the work surface 66 of the tungsten carbide insert. In a carbide insert away from the wall of the hole the diamond insert is embedded in a portion of the work surface extending farthest from the rolling cone cutter in which the tungsten carbide is mounted, as shown in FIG. 4. Placing a diamond insert in such a position has the greatest effect on increasing wear resistance of the tungsten carbide insert because the farthest extending portion of the work surface first engages rock formation, and thus is most likely to suffer wear.

Preferred locations for the diamond inserts in tungsten carbide inserts in a rolling cone cutter are in the gage row and in the heel row. Location of a diamond 68 in such a gage row insert 50 is illustrated in FIG. 3. The diamond insert is placed so that its surface is on the portion of the gage insert which is on the nominal gage of the bit. This places it in a position where it contacts the wall 52 of the hole instead of the bottom of the hole being drilled. Such a location tends to isolate the diamond from the impact loading that can occur against the bottom of the hole. It places the wear resistant surface of the diamond adjacent the hole wall where abrasion would otherwise affect the tungsten carbide insert.

FIG. 5 illustrates a heel insert for the cutter cone of FIG. 2 with a natural diamond brazed into the tungsten carbide heel insert. The diamond is arranged so that its surface is substantially flush with the flat face of the heel insert which would engage the wall of the hole. That is, the diamond is substantially on the nominal gage of the rock bit. Typically, the diamond protrudes from the tungsten carbide surface less than about 0.010 inch.

The diamond insert can be a natural or synthetic diamond. Preferably a synthetic polycrystalline diamond is used because of the low cost of such diamonds. A suitable size for a diamond insert ranges from about 0.15 to 1.0 carat depending on the bit size. Symmetrical or asymmetrical diamonds can be used. The hole 74 into which the diamond insert is placed can be formed by an electrical discharge machine. The diamond insert 68 can be maintained fixed in the hole 74 by a press fit, inlay brazing, or other retention technique.

In operation, because of the presence of the diamond insert, improved wear resistance of the tungsten carbide insert, and thus the drill bit, results. This is because the tungsten carbide resists compressive forces encountered during drilling while the diamond insert is strongly resistant to the effects of abrasion as an insert scrapes along the formation adjacent the hole being drilled. The cost of the diamond inserts is more than offset by savings from reduced frequency of bit changes. In addition, when drilling through formation to tap geothermal energy, a diamond insert improves the resistance of a tungsten carbide insert to the corrosive effects of hot water encountered.

Damage to diamonds in rock bits can occur because of extraordinary impact loads which fracture the diamonds or because of overheating due to inadequate cooling. When a bit having set diamonds is employed, care is taken to avoid impact loading on the diamonds. The diamonds in a set diamond bit are essentially continually in contact with the formation being drilled and high temperatures are easily generated. Temperatures of 450° F. have been measured and there have been reports of temperatures as high as 700° F. Cooling of the diamonds in a set diamond bit is quite important.

In the arrangement described herein, diamonds are present in tungsten carbide inserts on the rolling rock cutter cones of a rock bit. Such mounting of the diamonds provides extremely effective cooling. The heel inserts are exemplary. The heel inserts are adjacent the wall of the hole during about 10° or so of cone rotation. During the balance of each revolution of the cone the diamond inserts are remote from the hole wall and immersed in the cooling fluid in the hole. Such mounting significantly avoids diamond overheating problems.

Any or all of the cutting elements of a drill bit can be provided with a diamond insert. Preferably at least all of the tungsten carbide inserts in the gage row and/or heel row have diamond inserts because they are most susceptible to wear.

Although this invention has been described in considerable detail with reference to certain versions thereof, there are other versions within the scope of this invention. For example, although the invention has been described in terms of gage and heel inserts used at the periphery of the hole being drilled, this invention also contemplates use of tungsten carbide/diamond inserts for drilling against the surface of a core being drilled with a core type drill bit. Because of variations such as this, the spirit and scope of the appended claims should not necessarily be limited to the description of the preferred versions contained herein.

What is claimed is:

1. A rock drill bit having a rolling cone cutter with generally circular rows of tungsten carbide inserts mounted therein, the tungsten carbide inserts mounted in the roller cone cutter including a row of tungsten carbide inserts on the gage cutting row on the rock bit, the improvement wherein at least a portion of the tungsten carbide inserts in the gage cutting row have a diamond insert embedded in a work surface of such a tungsten carbide insert.

2. The rock drill bit of claim 1 in which each of the tungsten carbide inserts in the gage cutting rows of the rock bit has a diamond insert.

3. The rock drill bit of claim 1 in which the diamond insert is a polycrystalline diamond.

4. The rock drill bit of claim 1 in which the portion of such a tungsten carbide insert in which the diamond insert is embedded is the portion of the tungsten carbide insert extending farthest from the rolling cone cutter.

5. A rock drill bit comprising:

a rock bit body;

a plurality of rolling cone cutters mounted on the rock bit body for drilling a hole in rock formation;

a plurality of rows of tungsten carbide inserts in such a cone cutter for engaging rock formation to be drilled, including a plurality of such carbide inserts in a gage cutting row on each cutter cone on the rock bit; and a diamond insert in at least a portion of the tungsten carbide inserts in the gage cutting row of such a cone cutter on the rock bit.

6. The rock drill of claim 5 wherein such diamond inserts are in a portion of the tungsten carbide inserts which are intermittently on the gage of the rock bit.

7. A rock drill bit as recited in claim 5 further comprising:

a heel row of inserts in a portion of such a cone cutter which is intermittently adjacent the gage of the rock bit; and a diamond insert embedded in a work surface of at least a portion of the tungsten carbide inserts in the heel row.

8. A rock drill bit comprising:

a rock bit body;

a plurality of rolling cone cutters mounted on the rock bit body for drilling a hole in rock formation;

a plurality of rows of tungsten carbide inserts in such a cone cutter for engaging rock formation to be drilled, including a gage row of such carbide inserts adjacent the largest diameter of the cutter cone for cutting rock adjacent the gage of a hole being drilled; and a diamond insert embedded in a work surface of at least a portion of the tungsten carbide inserts in the gage row.

* * * * *